US005735549A

United States Patent [19]

Konkol et al.

[11] Patent Number: 5,735,549

[45] Date of Patent: Apr. 7, 1998

[54] DUAL USE PRODUCT OR SHIPPING LABEL

[75] Inventors: Patrick A. Konkol, Cincinnati; Hugh B. Skees, Dayton, both of Ohio

[73] Assignee: The Standard Register Company, Dayton, Ohio

[21] Appl. No.: 458,490

[22] Filed: Jun. 2, 1995

[51] Int. Cl.[6] ..... B42D 15/00

[52] U.S. Cl. ..... 283/81; 285/80; 285/56

[58] Field of Search ..... 283/79, 80, 81, 283/56; 281/2, 5

[56] References Cited

U.S. PATENT DOCUMENTS

| | | | |
|---|---|---|---|
| 4,614,361 | 9/1986 | Foster | 283/79 X |
| 4,856,819 | 8/1989 | Gollon | 283/79 |
| 4,968,547 | 11/1990 | McCarthy | 428/42 |
| 5,031,939 | 7/1991 | Webendorfer et al. | 283/81 |
| 5,071,167 | 12/1991 | O'Brien | 283/79 |
| 5,222,766 | 6/1993 | Instance | 283/81 |
| 5,267,898 | 12/1993 | Doll et al. | 462/6 |
| 5,284,689 | 2/1994 | Laurash et al. | 428/40 |
| 5,383,686 | 1/1995 | Laurash | 283/81 |
| 5,413,383 | 5/1995 | Laurash et al. | 283/79 |

*Primary Examiner*—Willmon Fridie, Jr.

*Attorney, Agent, or Firm*—Killworth, Gottman, Hagan & Schaeff, L.L.P.

[57] ABSTRACT

A tuck label construction which is simple and inexpensive to manufacture, is capable of being printed by a wide variety of conventional automated printing devices, and which can be printed with automated control systems such as bar codes is provided. In one form, the label includes a face ply having first and second major surfaces and a liner ply having first and second major surfaces. The first surface of the face ply includes an adhesive thereon which is adhered to the first surface of the liner ply, and the first surface of the liner ply contains a release agent thereon. Each of the face and liner plies includes a pair of end panels having center panels therebetween, with the end panels on the face ply being defined by lines of weakness between the end panels and the center panel on the face ply, and the end panels on the liner ply being Separated from the center panel on the liner ply.

16 Claims, 5 Drawing Sheets

DUAL USE PRODUCT OR SHIPPING LABEL

BACKGROUND OF THE INVENTION

The present invention relates to a label construction, and more particularly to a label construction which may be printed and folded so that certain exposed indicia may be removed from the label to expose additional previously hidden indicia.

Various types of special use labels are known in the art including those specialized labels known as "tuck" labels. A tuck label is one in which a portion of the label is folded or tucked beneath another portion of the label, and the tucked label is then adhered to a substrate. Such label constructions permit information which is printed on the tucked portion of the label to be hidden until the other portion of the label is removed. For example, the tucked portion of such a label may include a receipt or a return shipping address.

Webendorfer et al. U.S. Pat. No. 5,031,939, teaches one form of a tuck label in which a quantity of price tags are tucked beneath an associated pair of shipping labels mounted side-by-side on a release liner. The labels, which include a coating of a pressure sensitive adhesive, are removed from the release liner and adhered to a carton containing a plurality of individual products. The tucked price tags can be applied to the individual products in the shipping carton once the carton arrives at its intended destination.

Instance, U.S. Pat. No. 5,222,766, teaches a folded three panel label which is designed to be attached to a container such as a bottle or can. At least one of the second and third folded panels is designed to be removable to open up the label and expose information printed on the interior thereof.

O'Brien, U.S. Pat. No. 5,071,167, teaches a label containing both shipping and return mailing portions and an intermediate card connected to the two label portions by lines of perforations. The label is Z-folded and secured to a carton to be shipped. Once received, the recipient removes the shipping label and card and exposes the return mailing portion of the label.

Such labels have found many uses in the art. However, it is desirable that such labels be simple and inexpensive to manufacture. Further, such labels should be able to be readily printed using any of a number of conventional automated printing devices including, for example, impact, laser, thermal, thermal transfer, or ink jet. Additionally it is desirable that various bar codes be able to be printed readily onto such labels. Accordingly, there still exists a need in this art for a tuck label which includes these features.

SUMMARY OF THE INVENTION

The present invention meets those needs by providing a tuck label construction which is simple and inexpensive to manufacture, is capable of being printed by a wide variety of conventional automated printing devices, and which can be printed with automated control systems such as bar codes. The present invention accomplishes the dual or multiple functions of a tuck label, but with a simple an inexpensive to manufacture construction.

In accordance with one aspect of the present invention, a product or shipping label is provided and includes a face ply having first and second major surfaces. The face ply includes a pair of end panels having a center panel therebetween, and the end panels on the face ply include an adhesive on the first surface thereof. The end panels are defined by lines of weakness between the end panels and the center panel on the face ply. In this simplest of constructions for the tuck label of the present invention, the adhesive on the face ply may be either a moisture or heat activatable adhesive.

In another embodiment of the invention, the adhesive may be a pressure sensitive adhesive to provide a label which is easy to apply and adhere to a substrate. In this embodiment, the adhesive is coated on both the end panels and the center panel of the face ply. The label further includes a liner ply having first and second major surfaces, with the liner ply including a pair of end panels having a center panel therebetween. The end panels on the liner ply are separated from the center panel on the liner ply, for example, by a die cut. The first surface of the end panels of the liner ply contain a release agent thereon with the first surface of the liner ply being adhered to the first surface of the face ply. In this embodiment, the release agent is spot coated only onto the end panels so that the center panels of the face and liner plies are permanently adhered together. In a variation on this embodiment, the first surface of the center panel of the liner ply also includes a release agent thereon so that the entire first surface of the liner ply is coated. In this manner, the center panel of the liner ply may be removed from the label as will be explained in greater detail below.

Preferably, the respective center panels on the face and liner plies have a width substantially equal to or greater than the sum of the combined widths of the respective end panels. While the end panels will typically have the same width, it is within the scope of the present invention that the end panels may be of unequal widths. One or both of the end panels on the face ply may include printed indicia thereon. By "printed indicia" it is meant any combination of symbols, marks, letters, numbers, or the like which are either human or machine readable. Further, while the end panels of the liner ply are typically discarded, one or both of those panels may also include printed indicia thereon and may serve as record copies, proof of shipment, tracking labels, warehouse picking slips, or the like.

In one embodiment of the invention, the second surface of the center panel of the liner ply includes printed indicia thereon. In an alternative embodiment, the first surface of the center panel of the liner ply includes printed indicia thereon. Further, both of the second surface of the center panel of the liner ply and the first surface of the center panel of the liner ply may include printed indicia.

The present invention may also include a continuous web of the above-described product or shipping labels comprising a series of interconnected labels. The end panels on the face ply are defined by lines of weakness between the end panels and the center panel on the face ply, and the end panels on the liner ply are separated from the center panel on the liner ply. To aid in feeding the continuous web through a printing device, the web may include feed margins on either edge of the web.

The present invention also provides a method of applying the product or shipping labels described above to a substrate such as a package or article. The method includes the steps of providing a label comprising a face ply having first and second major surfaces and a liner ply having first and second major surfaces. Each of the face and liner plies includes a pair of end panels having center panels therebetween, with the end panels on the face ply being defined by lines of weakness between the end panels and the center panel on the face ply, and the end panels on the liner ply being separated from the center panel on the liner ply. The first surface of the face ply includes an adhesive thereon which is adhered to the first surface of the liner ply, and the first surface of the end panels of the liner ply contain a release agent thereon.

The end panels of the liner ply are removed to expose the adhesive on the first surface of the end panels of the face ply. The end panels of the face ply are folded back onto the center panel of the face ply along the lines of weakness. Finally, the label is adhered to the article by placing the exposed adhesive surfaces of the end panels of the face ply against a surface of the article.

In one embodiment, both of the center panels of the face ply and the liner ply of the label may be removed from the remainder of the label by tearing the center panel of the face ply along the lines of weakness, thereby revealing the end panels of the face ply and any previously hidden indicia printed thereon. In an alternative embodiment, the first surface of the center panel of the liner ply also includes a release agent coated therein. The center panel of the liner ply of the label can then be removed from the remainder of the label by separating the center panel of the liner ply from the adhesive along the release agent-containing first surface, thereby revealing the first surface of the face ply and any previously hidden indicia printed thereon. In the alternative embodiment, the center panel of the liner ply may be readhered to the label by adhering the second surface of the liner ply to the exposed adhesive on the label so that the first surface of the liner ply is visible.

The invention also includes a method for applying a simplified construction of the tuck label to an article. The method includes the steps of providing a label comprising a face ply having first and second major surfaces, with the first surface of the face ply including an adhesive thereon. The face ply includes a pair of end panels having a center panel therebetween, with the end panels on the face ply being defined by lines of weakness between the end panels and the center panel on the face ply. The adhesive on the first surface of the end panels of the face ply is activated, either by the application of heat or moisture depending upon the particular adhesive which has been chosen. Then, the end panels of the face ply are folded back onto the center panel of the face ply along the lines of weakness and the label is adhered to the article by placing the adhesive surfaces of the end panels of the face ply against a surface of the article.

Accordingly, it is a feature of the present invention to provide a tuck label construction which is simple and inexpensive to manufacture, is capable of being printed by a wide variety of conventional automated printing devices, which can be printed with automated control systems such as bar codes, and which can perform dual or multiple functions. This, and other features and advantages of the present invention, will become apparent from the following detailed description, the accompanying drawings, and the appended claims.

DETAILED DESCRIPTION OF THE PREFERRED EMBODIMENT

The present invention relates to a product or shipping label which can be printed on a plurality of surfaces using a variety of printing devices. Although the label may be used for a wide variety of end uses, the invention will be described with reference to preferred embodiments in which the label construction performs at least the dual functions of a product shipping label and a returned goods label. However, it will be apparent to those skilled in this art that the label may be used to indicate and record the completion of a step in a manufacturing process. Or, it may be used as a pricing label on a product where an original price printed on the center panel may be removed to reveal a sale price. Or, it may be used as a point of sale advertising device with attached coupon. Other portions of the label may be used to perform record keeping functions such as proof of shipment, record file copies, receipts, and the like.

Figure 1:
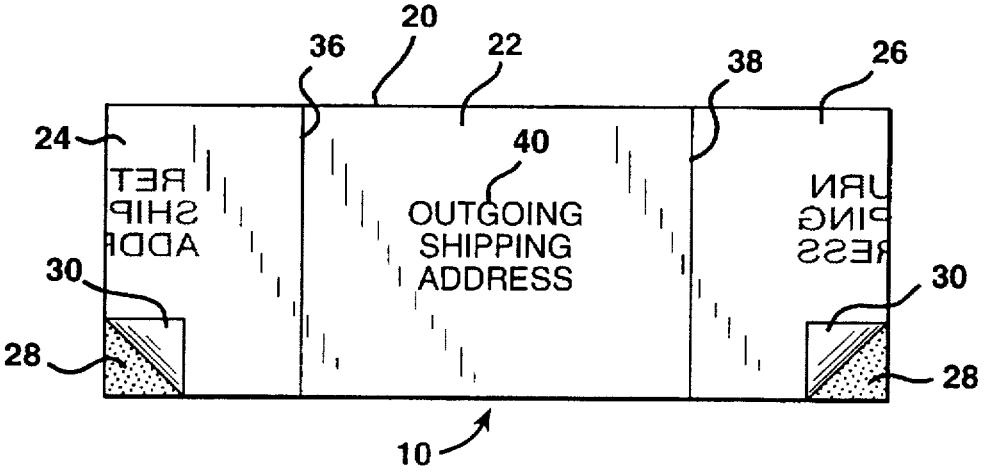
FIG. 1 is a front elevational view of one embodiment of the tuck label of the present invention which utilizes a pressure sensitive adhesive.
Figure 2:
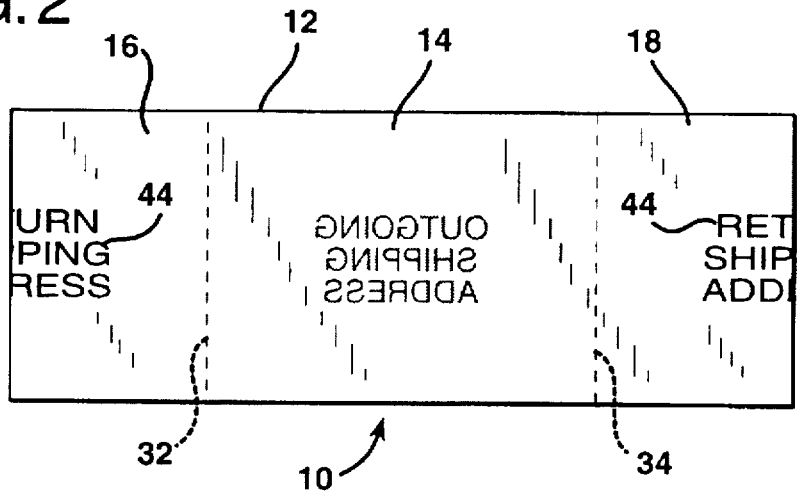
FIG. 2 is a rear elevational view of the tuck label of FIG. 1.
Figure 3:
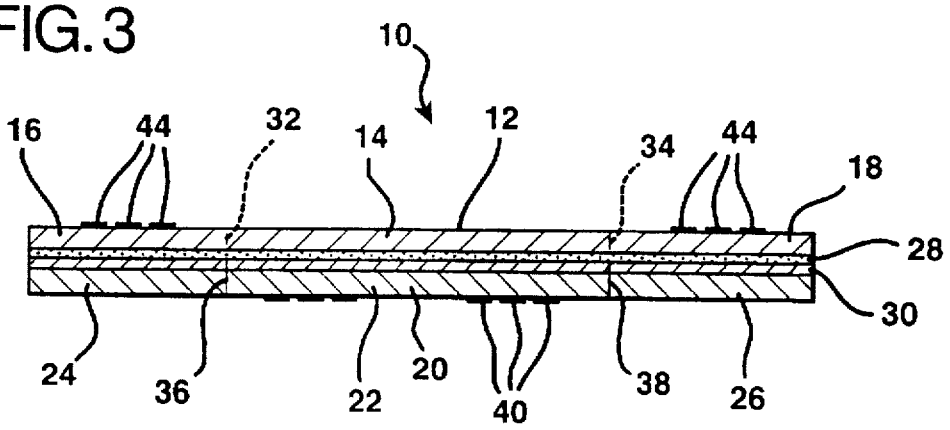
FIG. 3 is a side view of the tuck label of FIG. 1.

Referring now to FIGS. 1–3, one embodiment of the tuck label 10 of the present invention is illustrated and includes a face ply 12 having first and second major surfaces. Face ply 12 includes a center panel 14 and a pair of end panels 16 and 18 on either side thereof. The label also includes a liner ply 20 having first and second major surfaces and further having a center panel 22 and a pair of respective end panels 24 and 26 on either side thereof. As illustrated in this preferred embodiment, the respective widths of the end panels on both the face ply and liner ply are substantially equal, and the sum of their widths substantially equals the width of the center panel. However, it is within the scope of the invention to provide for end panels which have widths which differ from one another and which, in sum total, are not equal to the width of the center panel.

As shown, the first surface of face ply 12 includes a pressure sensitive adhesive 28 thereon. In other embodiments of the invention described below, other types of adhesives may be utilized. At least the first surface of the end panels of liner ply 20 which face adhesive layer 28 include a release agent 30 thereon to facilitate removal of the end panels as explained in further detail below. Thus, the tuck label may be manufactured by spot coating the release agent 30 only on the end panels 24 and 26 of the liner ply. This produces a tuck label in which the center panels of the face and liner plies 14 and 22 are permanently adhered together. However, as illustrated, the first surface of center panel 22 of liner ply 20 may also have a coating of release agent 30 thereon so that the center panel of the liner ply may be removed as will be explained in greater detail below.

The pressure sensitive adhesive and release agent which are used are conventional in the art. As shown in FIG. 1, end panels 24 and 26 of liner ply 20 are separated from center panel 22 by die cuts 36 and 38. End panels 16 and 18 of face ply 12 are defined by lines of weakness 32 and 34 which may be perforations or the like.

In the embodiment of the product shipping label as shown, the second surface of liner ply 20 includes indicia 40, such as an outgoing shipping address, thereon. On the second surface of face ply 12, indicia 44, such as a return shipping address, is printed on end panels 16 and 18; optionally, indicia (not shown) may also be printed on center panel 14. The indicia may include variable or non-variable information, or a combination of variable and non-variable information. By "variable" information, it is meant information which is unique to an individual label and which changes from label to label such as, for example, customer names, addresses, and order numbers. By "non-variable" information, it is meant information which is repetitive and which does not change from label to label such as, for example, a manufacturer's or product's name. The printed information may be in either or both human or machine readable form including bar coded information.

Figure 12:
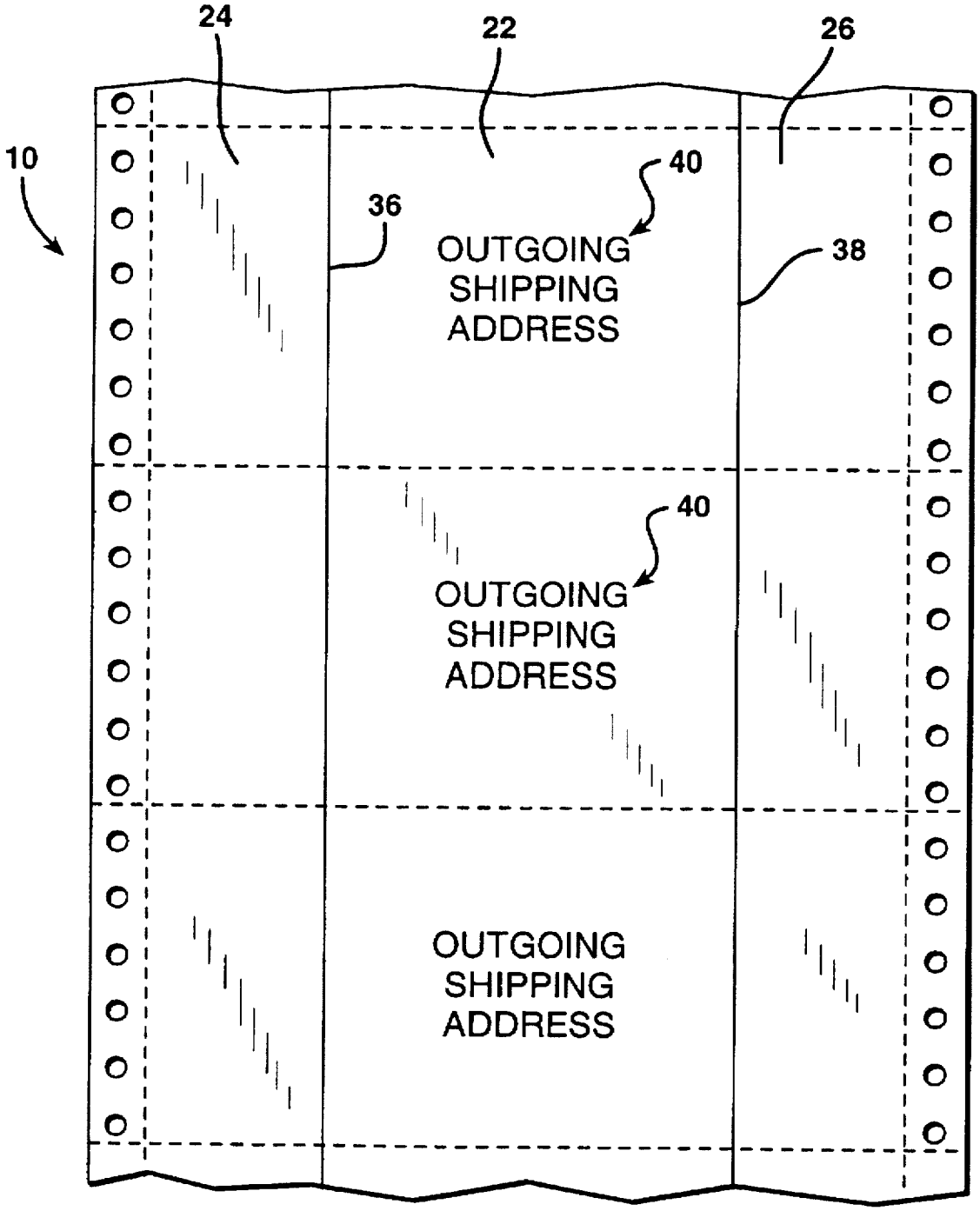
FIG. 12 is a front elevational view of a series of tuck labels in the form of a continuous web.

Preferably, labels 10 are manufactured in a continuous series from separate continuous webs of face stock and liner stock material which are then laminated together. FIG. 12 illustrates such a series of labels 10 in the form of a continuous web. The face and liner stocks may be any suitable material which can be printed on and may include either cellulosic or polymeric webs and films. Preferably, at least one or both of the face and liner webs are substantially opaque so that indicia printed on the reverse side of the label will remain hidden from view.

The face and liner webs may be printed first prior to their lamination or may be printed on pre-manufactured laminated stock. In an embodiment of the invention described in greater detail below, both surfaces of the liner stock may be printed. Nonvariable indicia are preferably printed by the manufacturer, while variable indicia may be printed later by an end user of the labels. Any of a number of conventional printing processes may be used including impact printers such as dot matrix, or nonimpact printers such as laser, ion deposition, thermal, thermal transfer, or ink jet, or even conventional flexographic printing. Either or both of the face and liner stocks may be coated papers containing thermally or pressure activated chemicals which form the indicia upon the application of heat or pressure. The webs may include control margins and pin holes for feeding a series of the labels through the printer as shown in FIG. 12.

Once printed, respective facing surfaces of the liner and face webs may be coated with release material and pressure sensitive adhesive and joined together. The face and liner webs may then be perfed and die cut to form a continuous two-ply laminated web having a series of individual labels.

Figure 4:
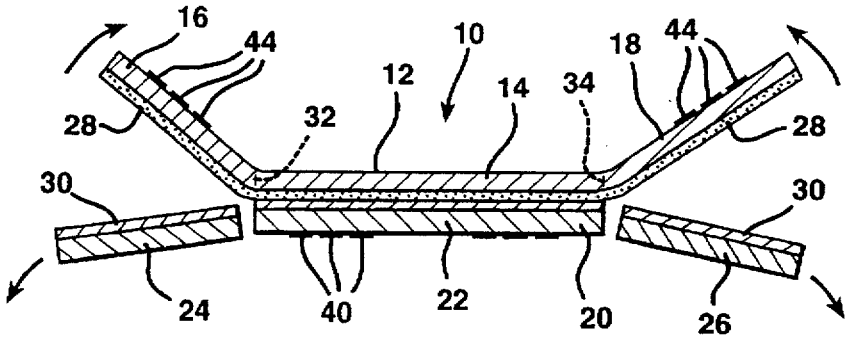
FIG. 4 is a side view illustrating removal of the end liner panels of the tuck label and the folding of the end panels of the face ply to tuck them behind the center panel.
Figure 5:
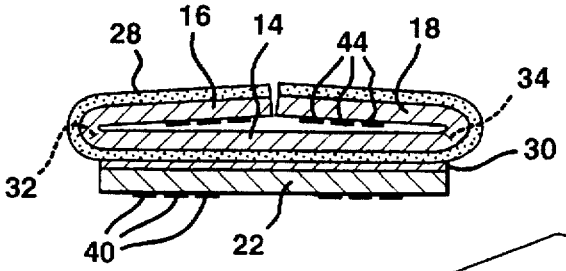
FIG. 5 is a side view illustrating the tuck label in a configuration to be adhered to a substrate.
Figure 6:
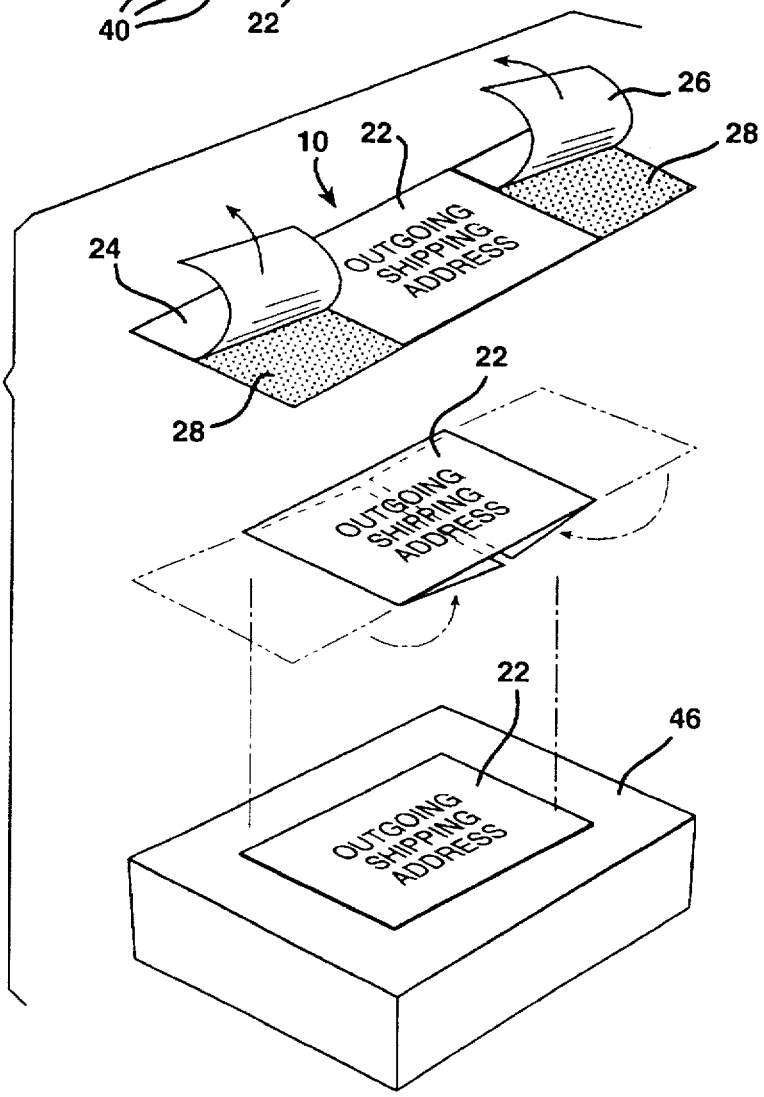
FIG. 6 is an exploded perspective view illustrating the steps of adhering the tuck label of the present invention to a substrate.

Referring now to FIG. 4–6, use and application of a label 10 to a package is shown. Initially, end panels 24 and 26 of liner ply 20 are peeled and separated from face ply 12 to reveal adhesive 28. End panels 24 and 26 are typically discarded; however, in certain embodiments of the invention, there may be indicia printed on one or both of these end panels. Such indicia may serve as a receipt, proof of shipment, or other information which can be saved and stored by a shipper.

As shown in FIG. 5, the end panels 16 and 18 of face ply 12 are then folded back 180°, and the label may then be secured, via adhesive 28, to a product or package 46. FIG. 6 illustrates the basic steps in the process. The end panels of the liner are peeled and separated, the end panels of the face are then folded under, and the label is applied and secured to a package.

Figure 7:
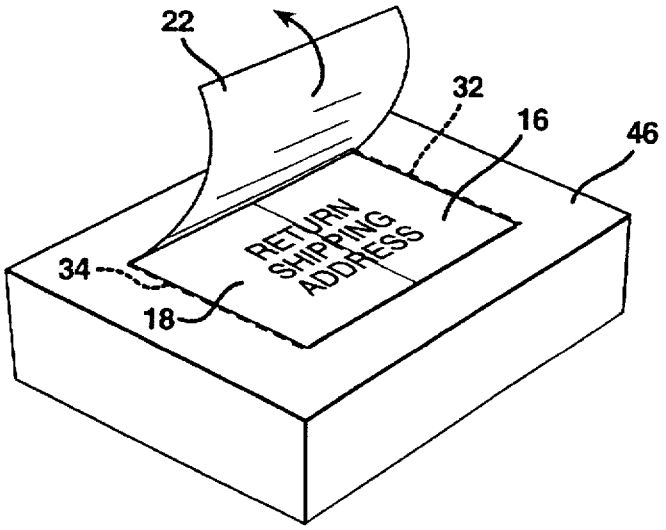
FIG. 7 is a perspective view illustrating the removal of the center panel to expose the printing on the tucked end panels beneath it.

Once the package reaches the addressee/recipient, if there is a problem or need to return the product to the original shipper, that can be accomplished using the dual function label. As shown in FIG. 7, the addressee/recipient merely tears adhered-together center panels 14 and 22 along perforations 32, 34 and removes it to reveal the return shipping address beneath it. As described above, the folded end panels 16, 18 of face ply 12 form the return shipping label. For this embodiment, face ply center panel 14 and liner ply center panel 22 may be permanently adhered together by omitting release agent 30 from being coated onto the first surface of center panel 22 during manufacture of the label.

Figure 8:
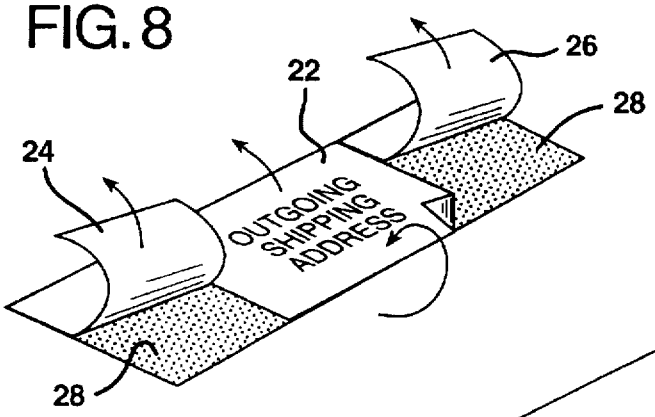
FIG. 8 is a perspective view illustrating an alternative embodiment of the invention.
Figure 9:
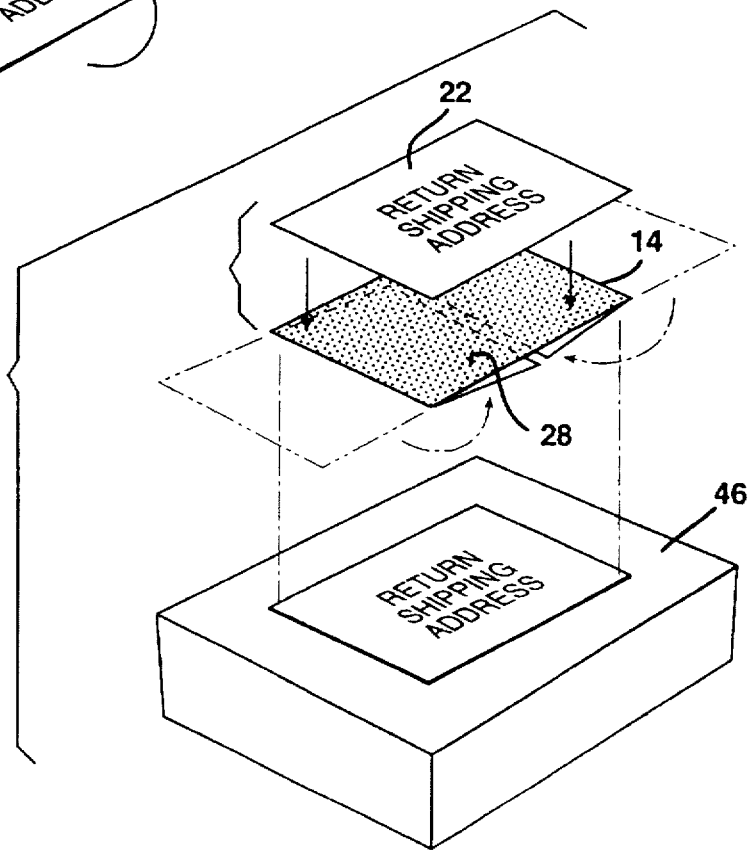
FIG. 9 is an exploded perspective view of the embodiment of the invention illustrated in FIG. 8, showing the removal of the center panel, turning it over, and readhering it to the substrate.

FIGS. 8 and 9 illustrate an alternative embodiment of the invention. In this embodiment, both surfaces of the center panel 22 of liner ply 20 are initially printed. The second (initially outward-facing) surface of center panel 22 is printed, for example, with an outgoing shipping address as shown. The first (initially adhesive-facing) surface of center panel 22 of liner ply 20 is printed with indicia, such as return shipping address information and then overcoated with the release material. Of course, the release material in this embodiment of the invention must be coated onto the first surface of liner ply center panel 22 and must also be substantially transparent. Most commercially-available silicone release materials meet the requirement of transparency.

As before, end panels 24 and 26 of liner ply 20 are peeled away and separated, and end panels 16 and 18 of face ply 12 are folded 180° beneath and secured to package However, in this embodiment of the invention, to return the package back to the original sender, the addressee/recipient merely peels center panel 22 of the liner ply from adhesive 28 as shown by the arrow in FIG. 8 and then turns the center panel over to reveal the return shipping address information. Center panel 22 is then readhered, opposite side up, to adhesive 28 and package 46, hiding the previously exposed outgoing shipping information.

Figure 10:
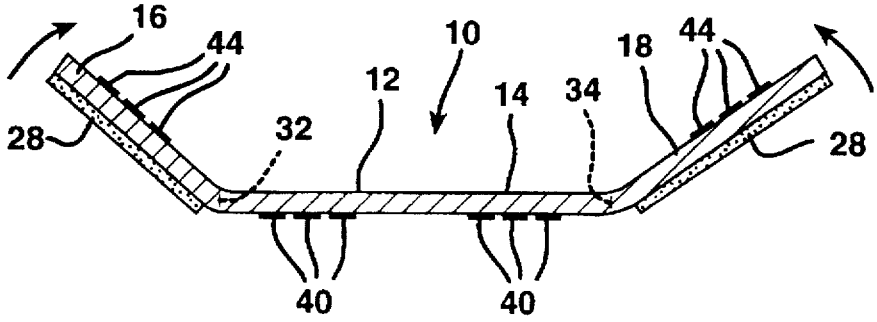
FIG. 10 is a side view of a simplified tuck label construction.
Figure 11:
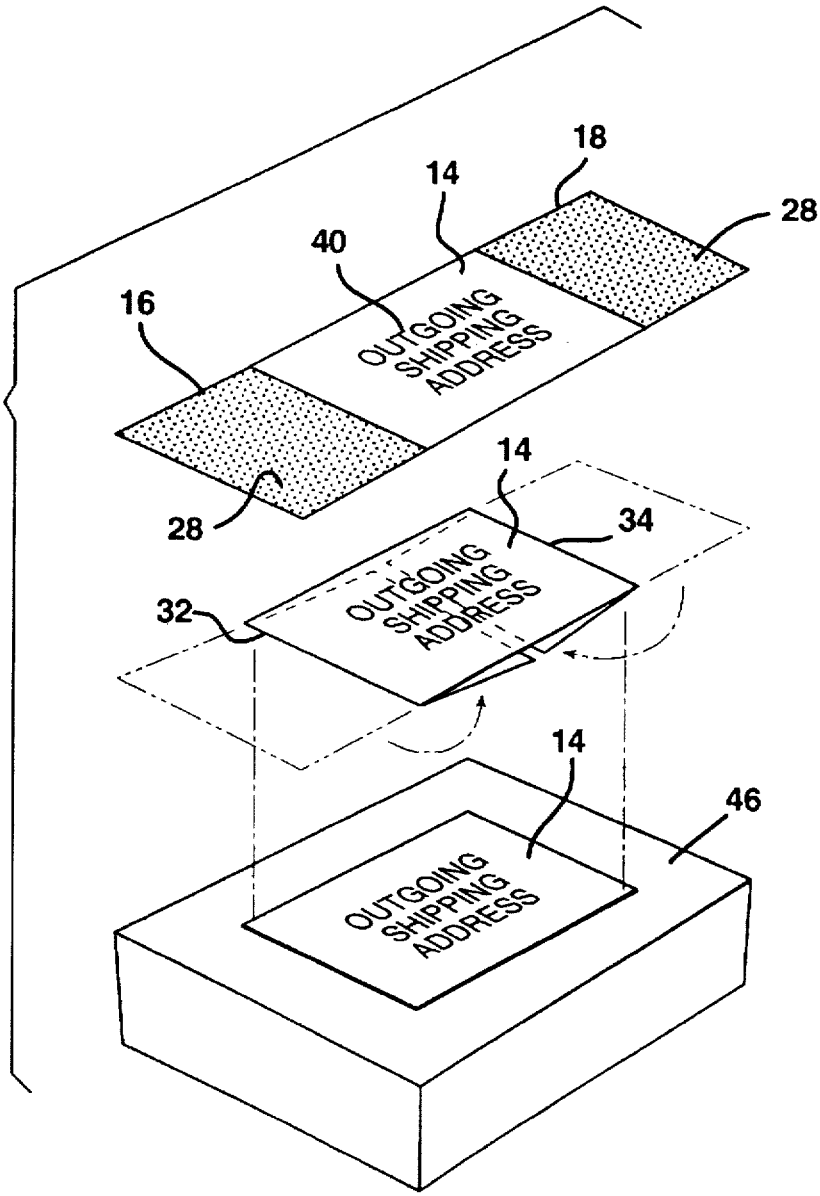
FIG. 11 is an exploded perspective view illustrating the steps of adhering the tuck label to a substrate.

FIGS. 10 and 11 illustrate a simplified construction of the tuck label 10, where like elements are referred to by like reference numerals. In this embodiment of the invention, adhesive 28 is a moisture or heat activatable adhesive. Conventional water remoistenable and hot melt adhesives are well known in this art. Because the surface of adhesive 28 is nontacky until activated, there is no need for a liner ply. This results in a less expensive tuck label construction while still providing the dual use characteristics for the label.

As shown in FIGS. 10 and 11, tuck label 10 includes only face ply 12 having first and second major surfaces. Face ply 12 includes a center panel 14 and a pair of end panels 16 and 18 on either side thereof. As shown, the first surface of face ply 12 includes an adhesive 28 on end panels 16 and 18. As discussed above, adhesive 28 in this embodiment of the invention is a moisture or heat activatable adhesive. The first surface of face ply 12 includes indicia 40, such as an outgoing shipping address, thereon. On the second surface of face ply 12, indicia 44, such as a return shipping address, is printed on end panels 16 and 18.

As shown in FIG. 11, tuck label 10 may be secured to a product or package 46 by activating adhesive 28 and then folding end panels 16 and 18 of face ply 12 beneath center ply 14. Tuck label 10 is then secured, via adhesive 28, to a product or package 46. Once the package reaches the addressee/recipient, if there is a problem or need to return the product to the original shipper, that can be accomplished by tearing and removing center ply 14 along perforations 32 and 34 to expose indicia 44 (a return shipping address, for example) printed on tucked end panels 16 and 18.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A product or shipping label comprising: a face ply having first and second major surfaces and a liner ply having first and second major surfaces with said second major surface of said liner ply including indicia thereon, said face ply and said liner ply each including a pair of end panels having a center panel therebetween; wherein said end panels on said face ply include an adhesive on said first surface thereof and are defined by lines of weakness between said end panels and said center panel; wherein said end panels on said liner ply include a release agent on said first surface thereof and are separated from said center panel; and wherein said first surface of said liner ply is adhered to said first surface of said face ply.

2. A product or shipping label as claimed in claim 1 in which said adhesive is moisture activatable.

3. A product or shipping label as claimed in claim 1 which said adhesive is heat activatable.

4. A product or shipping label as claimed in claim 1 in which said adhesive on said first surface of said face ply is a pressure sensitive adhesive coated on both said end panels and said center panel.

5. A product or shipping label as claimed in claim 4 in which said first surface of said center panel of said liner ply also includes a release agent thereon.

6. A product or shipping label as claimed in claim 1 in which said center panel on said face ply has a width substantially equal to or greater than the sum of the combined widths of said respective end panels.

7. A product or shipping label as claimed in claim 1 in which the respective center panels on said face and liner plies have a width substantially equal to or greater than the sum of the combined widths of said respective end panels.

8. A product or shipping label as claimed in claim 1 in which said second surface of one or both of said end panels on said face ply include printed indicia thereon.

9. A product or shipping label as claimed in claim 1 in which said second surface of said center panel of said liner ply includes printed indicia thereon.

10. A product or shipping label as claimed in claim 1 in which said first surface of said center panel of said liner ply includes printed indicia thereon.

11. A product or shipping label as claimed in claim 1 in which both of said second surface of said center panel of said liner ply and said first surface of said center panel of said liner ply include printed indicia.

12. A product or shipping label as claimed in claim 1 in which said second surface of one or both end panels of said liner ply include printed indicia thereon.

13. A product or shipping label as claimed in claim 1 including a series of product or shipping labels in a continuous web of interconnected labels.

14. A product or shipping label as claimed in claim 4 including a series of product or shipping labels in a continuous web of interconnected labels.

15. A product or shipping label as claimed in claim 13 including feed margins on either edge of said web for feeding said web through a printer.

16. A product or shipping label as claimed in claim 14 including feed margins on either edge of said web for feeding said web through a printer.

* * * * *